United States Patent [19]

Combette et al.

[11] 4,112,685

[45] Sep. 12, 1978

[54] LOADING DEVICE FOR A POWER ACTUATED TOOL

[76] Inventors: Marc Combette, 116 rue des Moulins; Jean Ollivier, 89 avenue des Beaumes, both of Valence, France, 26000

[21] Appl. No.: 745,747

[22] Filed: Nov. 29, 1976

[51] Int. Cl.[2] ..... F01B 29/08; F02N 13/00

[52] U.S. Cl. ..... 60/634

[58] Field of Search ..... 60/634

[56] References Cited

U.S. PATENT DOCUMENTS

| | | | |
|---|---|---|---|
| 296,052 | 4/1884 | Peyton | 60/634 |
| 3,330,108 | 7/1967 | Kvavle et al. | 60/634 |

*Primary Examiner*—Wendell E. Burns

*Attorney, Agent, or Firm*—William W. Jones; Paul J. Lerner

[57] ABSTRACT

A loading device for a power-actuated tool which comprises a fixed support having an open recess adapted to receive the open end of a tubular propellant charge-retaining holder. A movable charge transporter is mounted on the exterior of the tool and contains a through passage which is movable between a charge-receiving position adjacent to the fixed support recess, and a charge-loading position adjacent to the firing chamber of the tool. Charges are gravity fed from the transporter to the firing chamber. The transporter moves to and from the loading position by pivoting through a pre-existing loading port in the tool.

9 Claims, 6 Drawing Figures

LOADING DEVICE FOR A POWER ACTUATED TOOL

The present invention relates to a loading device for a power actuated tool with a firing chamber in the rear end of the barrel and accessible from the exterior, for example, by means of a loading port in the tool housing.

Devices have already been proposed having a channel or groove on the outside of a power-actuated tool in which channel or groove the charges are placed in series one behind the other and which channel or groove can move between two extreme positions, in one of which the channel communicates with the chamber located at the rear end of the barrel.

Tools are also known which have a fixed tubular magazine in a bore of the breech block, from where the charges are successively forced into the firing chamber by a pivoting lever.

The object of the present invention is a loading device which is easily adaptable to known power-actuated tools using an externally accessible loading port formed in the tool housing. The loading device is easy to manufacture and use and has a large storage capacity.

To this end, the device according to the invention comprises, on the one hand, a fixed support in which is provided a recess open at its two ends and arranged at one side to receive the open end of a charge packaging tubular member, and arranged at the other side to provide successive discharge of individual propellant charges. Associated with the fixed support is a transfer means, movable relative to the support, in which is provided an open cylindrical recess arranged for receiving a single charge. The transfer means is mounted in such a way that it can be moved from a first position, in which its recess registers with that of the fixed support, through the tool loading port to a second position, in which its recess registers with the firing chamber of the tool, which firing chamber is located in the rear end of the barrel of the tool.

The device according to the invention is well suited to the case where feeding and loading take place by gravity. In this case, means are provided for ensuring at least partial closure of the outlet port of the transfer means as it moves from its first position until it arrives in its second position. Means may also be provided for ensuring at least partial closure of the outlet port of the open recess of the fixed support when the movable transfer means is not in its first position.

According to a preferred embodiment, the transfer means is mounted in pivotal relationship with the fixed support, and the closure means for the outlet port of the transfer means is formed by a plate-like member movable with the transfer means. The closure means for the outlet port of the open recess of the fixed support, moreover, is formed by a part of the movable transfer means. The fixed support may take the configuration of a fork, between whose bifurcations is mounted the transfer means. One of the bifurcations of the fork may be the part in which the reception recess for the charge packaging member is provided.

A preferred embodiment of the invention will now be described with reference to the accompanying drawings, in which.

Figure 1:
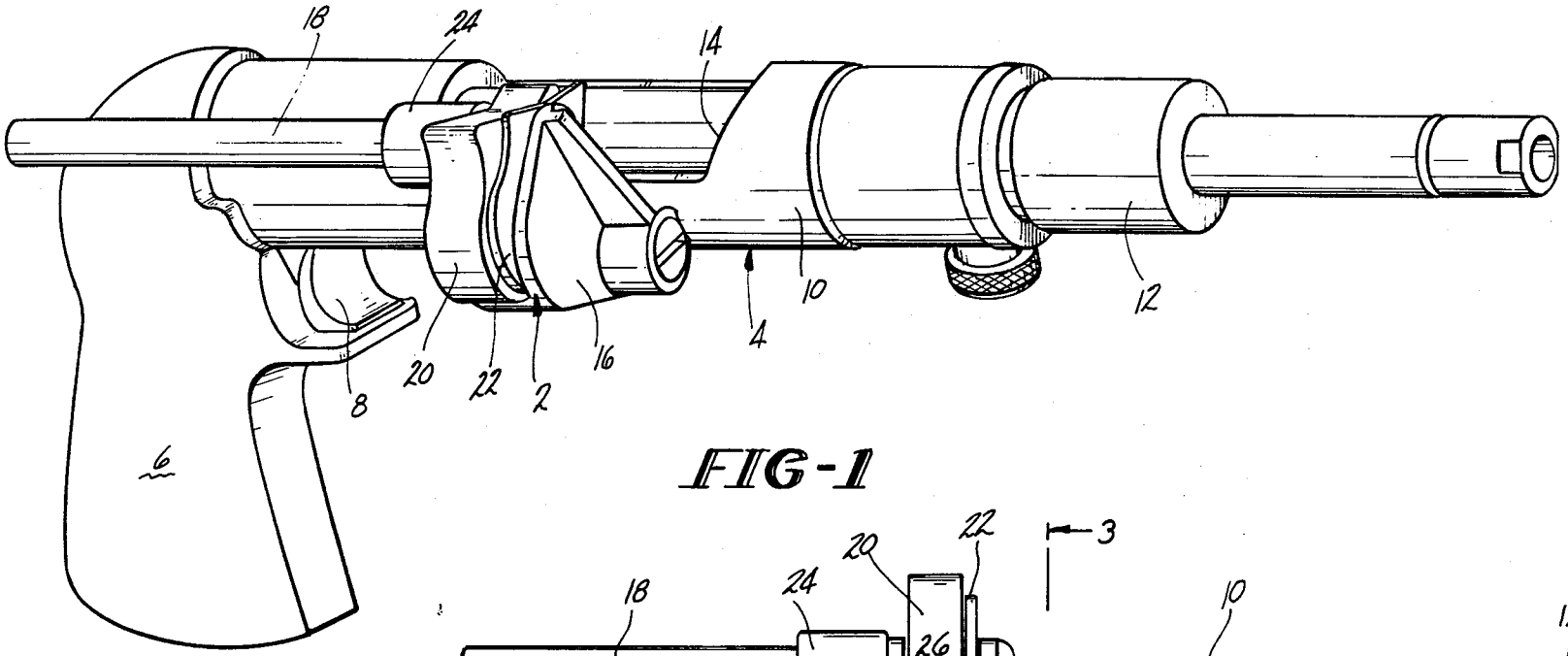
FIG. 1 is a perspective view of a power-actuated fastener driving tool on the exterior which is mounted one embodiment of the charge loading device of this invention.
Figure 2:
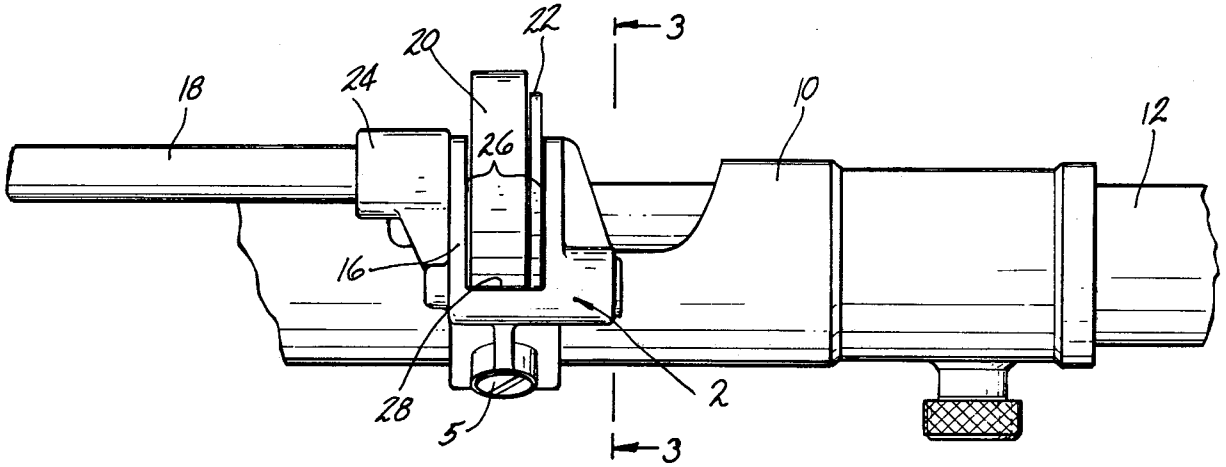
FIG. 2 is a side elevational view of a part of the device of FIG. 1.

Referring now to FIGS. 1 and 2, a preferred embodiment of the loading device, identified generally by the numeral 2, is shown mounted on a power-actuated tool identified generally by the numeral 4. The tool has a handle 6, a trigger 8, a main housing part 10 to which the handle is secured, and a barrel assembly 12 which is reciprocably slidable in the housing 10 between a forward loading position and a rearward battery position. The housing 10 includes a loading port 14 through which the firing chamber of the tool is accessible when the barrel assembly 12 is pulled to its forward loading position, the firing chamber being located at the rearward end of the barrel assembly.

The loading device includes a support portion 16 which is secured by screws 5 to the tool housing 10. A powder charge magazine 18 is secured to the support portion 16 rearwardly of the loading port 14. A charge transfer member 20 is pivotally mounted on the support portion 16 forward of the magazine 18 and alongside of the loading port 14. A charge release control plate 22 is pivotally mounted on the support portion 16 forwardly adjacent to the transfer member 20. The loading device is shown in FIGS. 1 and 2 in its charge pick up position wherein it receives a charge from the magazine 18 in a manner to be described hereinafter. In the pick up position, it will be noted that the entire loading device including the transfer member 20 and control plate 22 is disposed outside of the tool housing 10 so that the barrel assembly 12 can be freely reciprocated without contacting the loading device. As shown in FIG. 1, the barrel assembly 12 is in its breech-closed or firing position. It will be noted from FIGS. 1 and 2 that the support portion includes a rearward boss 24 to which the magazine 18 is secured. It will also be noted that the support member 16 preferably takes the form of a fork or clevis having a central gap 26 in which the transfer member 20 and control plate 22 are mounted. The gap 26 has a lower or bottom wall 28 whose function will be set forth in greater detail hereinafter.

Figure 3:
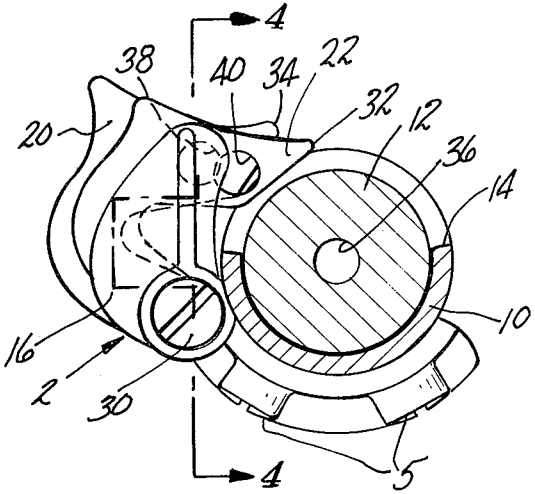
FIG. 3 is a sectional view of the device taken along line 3—3 of FIG. 2.

Referring now to FIG. 3 it will be noted that both the transfer member 20 and the control plate 22 are pivotally mounted on a pin 30 which is set into the support member 16. The control plate 22 is formed with a forward end contact surface 32 which limits the extent of clockwise pivotal movement the plate 22 can undergo about the pin 30. Similarly, the transfer member 20 is also formed with a forward end contact surface 34 which limits the extent of clockwise pivotal movement the transfer member 20. It will be noted that when the transfer member 20 and control plate 22 are in the charge-receiving position, the respective contact surfaces 32 and 34 are offset from each other, the surface 32 being forward in the clockwise direction of the surface 34. It will also be noted that the barrel 12 is free of interference from the loading mechanism 2 when the latter is in its charge-receiving position. The firing chamber 36 is shown in FIG. 3 in its location on the axis of the barrel assembly 12. The charge transfer member is formed with a through passage 38 which is axially parallel with the firing chamber 36. The control plate 22 is also formed with a through passage 40 which is axially parallel to the firing chamber 36 and transfer passage 38. It will be noted from FIG. 3 that the control plate passage 40 is offset from the transfer passage 38 in a clockwise direction so that the control plate 22 effectively closes off the adjacent end of the transfer passage 38.

Figure 4:
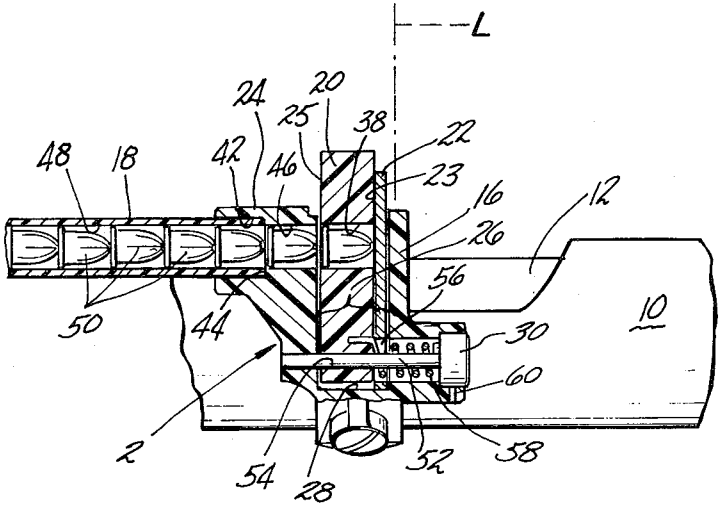
FIG. 4 is a sectional view of the device taken along line 4—4 of FIG. 3.

Referring now to FIG. 4, it will be seen that the support member boss 24 is formed with a stepped through passage which is coaxial with the transfer passage 38 when the transfer member 20 is in the charge receiving position. The stepped through passage includes a larger diameter portion 42 which terminates at a radial shoulder 44 and into which the tubular magazine 18 is telescoped and held by friction. The passage portion 42 opens into a smaller diameter portion 46 which is similar in diameter to the transfer passage 38 and to the bore 48 of the magazine 18. Inside of the magazine there are stacked, one on top of another, a column of charges 50 which are used to power the tool. The magazine bore 48, the passage portion 46 and the transfer passage 38 are all sized so that the charges 50 can slide therethrough under the influence of gravity when the tool is oriented in a muzzle-down position. The charges 50, however, at all times retain their preoriented condition so they can be fired when chambered. It should also be noted that the control plate passage 40 is about the same diameter as the transfer passage 38, e.g. large enough to pass a charge 50.

Details of the mode of mounting the transfer member 20 and control plate 22 on the support member 16 are also shown in FIG. 4. It will be noted that the pin 30 has a stem portion 52 which extends across the clevis gap 26 upwards of the bottom surface 28 thereof. The stem 52 extends through a hole 54 in the transfer member 20 and a hole 56 in the control plate 22. A torsion spring 58 is mounted on the stem 52 and has one end thereof secured in the pin head 30 and the other end thereof secured in the transfer member 20. The transfer member 20 is thus biased in a counter-clockwise direction (as viewed in FIG. 3) about the pin 30. The pin 30 is preferably staked in place by a staking pin 60.

As will be readily seen from FIG. 4, when the magazine feed end is opened and the magazine 18 is inserted into the boss bore 42 and the tool held muzzle down with the transfer member 20 and control plate 22 in the charge-receiving position, a charge will still slide from the magazine through the bore 46 and into the transfer passage 38. The transfer member 20 is only thick enough to contain one charge at a time. The rear face 23 of the control plate 22 will block the charge 50 from passing completely through the transfer passage 38 when the loading mechanism is in the charge-receiving position. The rear surface 25 of the transfer member 20 acts as a similar blocking means for the charge contained in the boss passage 46 when the transfer member is out of its charge-receiving position, as will be explained in greater detail hereinafter.

Figure 6:
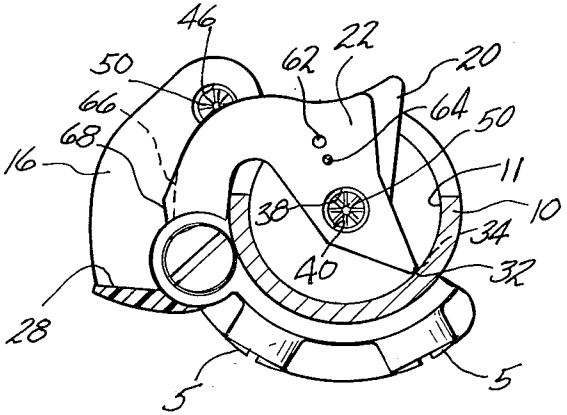
FIG. 6 is a view similar to that of FIG. 5, the transfer member being in the charge-loading position.
Figure 5:
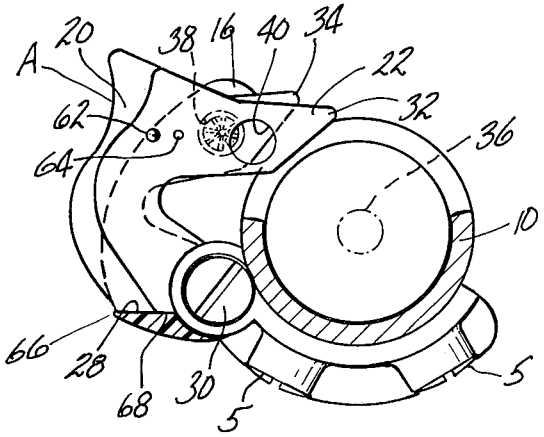
FIG. 5 is a view analogous to that of FIG. 3, with parts broken away for clarity and with the transfer member being shown in the charge-receiving position.

Referring now to FIGS. 5 and 6, the mode of operation of the loading mechanism is shown. A portion of the clevis-shaped support member 16 has been broken away for clarity. It will be noted that the control plate 22 includes a pair of small holes 62 and 64 therethrough. These holes 62 and 64 receive a spring-biased ball detent which is disposed in a blind bore in the transfer member 20. The ball detent ensures that the plate 22 will pivot with the transfer member 20 when the latter moves in the loading sequence. As shown in FIG. 5, the ball detent is engaging the hole 64. As shown in FIG. 6, the ball detent is engaging the hole 62. Thus the ball detent imposes onto the control plate 22 whatever pivotal moment is acting upon the transfer member 20. In FIG. 5, the spring 58 is biasing the transfer member 22 counter-clockwise into its charge-receiving position. The transfer member 20 is provided with a flat side surface 66 which is biased into snug contact with the clevis bottom wall 28 so as to provide a counter-clockwise stop for the transfer member 22. This stop positively locates the transfer passage 38 coaxially with the boss passage 46 so that a charge will be picked up by the transfer member 20. The control plate 22 is also formed with a flat side surface 68 which is biased into snug engagement with the clevis bottom wall 28 by the ball detent and spring combination, thus forming a counter-clockwise stop for the control plate 22, which stop positively locates the control plate passage 40 in its offset position shown in FIG. 5 wherein the charge to be transferred is prevented from passing through the transfer passage.

To chamber a charge, the loading assembly is moved from the position shown in FIG. 5 to the position shown in FIG. 6 while the tool is held in a muzzle-down orientation. Prior to the loading operation, the barrel assembly 12 is pulled forward as far as it will go, which results in positioning of the rear wall of the barrel assembly in the plane shown in FIG. 4 by the phantom line L. The firing chamber of the tool opens out through the rear wall of the barrel assembly and its location is shown in FIG. 5 by the phantom line 36. After the tool has been opened in this manner, and while the tool remains held in the muzzle-down attitude, the operator presses the area A (see FIG. 5) on the transfer member 20 with his thumb and pushes the transfer member 20 in a clockwise direction about the pin 30. By reason of the ball detent, the control plate 22 will move with the transfer member 20 and maintain the relative position shown in FIG. 5 so that the control plate will prevent the charge in the passage 38 from dropping down therefrom in the direction of the tool muzzle. This pivoting movement is continued until the control plate contact surface 32 engages the inner surface 11 of the tool housing 10. At this point clockwise movement of the control plate 22 will stop and the control plate passage 40 will be aligned with the firing chamber 36. Thus a clockwise stop is formed to locate the control plate 22 for proper feeding of a charge into the firing chamber of the tool. Continued pressure on the transfer member 20 causes further clockwise movement thereof to occur with a resultant withdrawal of the ball detent from the control plate hole 64. This further clockwise movement of the transfer member 20 ceases when the transfer member contact surface 34 engages the inner surface 11 of the tool housing 10 at which point the transfer passage 38 will align with the control plate passage 40 and with the firing chamber 36 and the charge 60 will slide through both passages under the influence of gravity and seat in the firing chamber 36. Furthermore the ball detent will engage the control plate hole 62 to provide a positive connection once again between the transfer member 20 and the control plate 22.

It will be observed from FIG. 6 that when the transfer member 20 is in its cartridge loading position, the rearward surface 25 thereof (see FIG. 4) still overlies the boss passage 46 sufficiently to prevent the next-in-line charge 60 from falling therefrom. Thus the next charge is held in place until the transfer passage 38 returns to the charge-receiving position, at which time that next charge will fall into the transfer passage. It will also be observed from FIG. 6 that when the contact surfaces 32 and 34 of the control plate 22 and transfer member 20 respectively are both engaging the housing surface 11, the side surface 66 of the transfer member 20 is offset in a clockwise direction from the side surface 8 of the control plate 22.

When the charge is loaded in the firing chamber the surface A is released and the spring 58 causes the transfer member 20 to pivot in a counter-clockwise direction back to its charge-pickup position. The ball detent in the hole 64 causes the control plate 22 to pivot back to its initial position. Pivoting of the control plate 22 will stop before pivoting of the transfer member 20 because the end surface 68 of the control plate 22 will engage the clevis wall 28 before the end surface 66 of the transfer member 20. Once the control plate ceases its return pivotal movement, the ball detent will disengage from the hole 64 and move over to re-engage the hole 62. A fresh charge will then be picked up and the device will be ready for reuse after the tool is fired.

It will be readily appreciated that the loading device of this invention is relatively simple construction. It can be mounted on any tool that includes a forwardly sliding barrel assembly with the firing chamber at the rear end thereof by simply drilling and tapping two holes in the tool housing. The loading device can be easily and inexpensively made from molded plastic material. The springs, balls, pins, and screws are metal. The control plate can also be made of metal. The loading device is thus quite light in weight and does not add appreciably to the weight of the tool. The magazine with which the loading device is used can have a bore of large enough diameter so that the charges can slide therethrough under the influence of gravity alone, or can include a spring-biased follower, if desired.

Since many changes and variations of the disclosed embodiment of the invention may be made without departing from the inventive concept, it is not intended to limit the invention otherwise than as required by the appended claims.

What is claimed is:

1. In a power-actuated tool of the type having a housing with a loading port through which a power charge can be loaded into the tool, the tool also having a barrel assembly slidable in the housing between a rearward firing position and a forward loading position and return, the barrel having opening through its rearward end a firing chamber for reception of a power charge, an improved loading assembly comprising:

(a) support means fixedly secured to an outer surface of said tool housing, said support means being adapted to releasably support a container of stacked power charges, and said support means having a through bore sized to permit free passage of the power charges from the container thereof through at least a portion of said support means;

(b) transfer means movably mounted on the exterior of said tool housing, said transfer means being movable between a charge-receiving position and a charge-loading position and return, said transfer means being provided with a bore, open at both ends, for receiving ones of the power charges to transport the latter from the support means to the tool firing chamber, said transfer means bore being coaxial with said support means through bore when said transfer means is in said charge-receiving position, and said transfer means bore being coaxial with said tool firing chamber when said transfer means is in said charge-loading position, said transfer means bore having an axial dimension which is only slightly longer than the axial length of a power charge and having a diameter which is larger than the diameter of a power charge to permit the power charge to slide through said transfer means bore solely under the influence of gravity, said transfer means having an end portion in which said transfer means bore is located, which end portion is adapted to pass through said tool loading port upon actuation of said transfer means;

(c) first means adjacent to said support means for selectively overlying said support means through bore to close the latter against passage of a power charge therethrough when said transfer means is not in said first position;

(d) second means adjacent to said transfer means for overlying said transfer means bore until said transfer means is in said second charge-loading position; and (e) locating means on said transfer means for stopping movement of said transfer means in each of said first and second positions to ensure proper positioning of said transfer means bore.

2. In a power-actuated tool of the type having a housing with a loading port through which power charges can be loaded into the tool, the tool also having a barrel assembly slidable in the housing between a rearward firing position and a forward loading position and return, the barrel assembly having a firing chamber which is accessible for loading through said loading part when the barrel assembly is in the forward loading position, an improved loading assembly comprising:

(a) support means secured to the exterior of said housing and adapted to releasably support a container of stacked power charges and provide an opening through which individual power charges can be fed from the container thereof;

(b) transfer means having a bore sized to receive a single power charge and pass the latter from the bore solely by means of gravity, said bore being positioned near one end of said transfer means and having a charge-receiving open end and a charge-feeding open end positioned on a common axis which is parallel to the axis of the tool firing chamber, said transfer means being mounted on the exterior of the tool and movable between a charge-receiving position wherein said bore is coaxial with said support means opening, and a charge-loading position wherein said one end of said transfer means extends through said tool loading port and said bore is coaxial with said tool firing chamber;

(c) first means adjacent to said support means opening to at least partially close off the latter to prevent a power charge from passing therethrough whenever said transfer means is not in said charge-receiving position;

(d) second means adjacent to said charge-feeding open end of said bore to at least partially close off the latter to prevent a power charge from passing therethrough when said transfer means is not in said charge loading position; and (e) locating means on said transfer means for providing stops for movement of said transfer means when the latter is in said charge-receiving position and said charge-loading position.

3. In a power-actuated tool of the type having a housing with a loading port through which a power charge can be loaded into the tool, the tool also having a barrel assembly slidable in the housing between a rearward firing position and a forward loading position and return, the barrel assembly having a firing chamber which is accessible for loading through said loading port when the barrel assembly is in the forward loading position, an improved loading assembly comprising:

(a) a support in the form of a bifurcated fork secured to the exterior of said tool housing, one bifurcation of said fork being adapted to releasably support a tubular power charge magazine on said tool, said one bifurcation providing an opening through which power charges can pass from the magazine;

(b) charge transfer means in the form of an elongated arm having a through passage adjacent to one end thereof and sized to receive and pass by gravity therethrough single power charges, said arm being pivotally mounted at its other end to a pin extending between said bifurcations with said arm being movable between a charge-receiving position wherein one end of said through passage aligns with said charge-passing opening, and a charge-loading position wherein said one end of said arm projects through said loading port and the other end of said through passage aligns with said firing chamber;

(c) means on said support including a surface adjacent to said transfer means which prevents passage of a power charge through said other end of said through passage when said transfer means is out of said charge-loading position;

(d) means adjacent to said opening which at least partially closes the latter against passage of a power charge therethrough when said transfer means is out of said charge-receiving position; and (e) means on said transfer means for providing motion stops for said transfer means when the latter is in said charge-receiving and charge-loading positions to properly locate said transfer means in each of said positions.

4. The tool of claim 3, further comprising spring means engaging said transfer means to bias the latter toward said charge-receiving position.

5. The tool of claim 3, wherein said one bifurcation is located rearwardly of said loading port and said transfer means is located forwardly of said one bifurcation, said firing chamber being forward of said transfer means when said barrel assembly is in its forward position, whereby the power charges are fed by gravity from the magazine into said transfer means passage, and by gravity from said transfer means passage into said firing chamber when the tool is held in a muzzle-down position and said transfer means is moved from said charge-receiving position to said charge-loading position.

6. For use with a power-actuated tool of the type having a housing with a loading port through which a power charge can be loaded into the tool, the tool also having a barrel assembly slidable in the housing between a rearward firing position and a forward loading position and return, the barrel assembly having a firing chamber located at its rearward end, an improved loading assembly comprising:

(a) charge transfer means in the form of an elongated arm having a through passage adjacent to one end thereof, which passage is sized to receive and pass by gravity a single power charge, said transfer means being adapted to be pivotally mounted on the exterior of the tool housing and movable from a charge-receiving position to a loading position wherein said one end thereof extends through the tool loading port and said passage is coaxial with the firing chamber, said transfer means including a side surface thereof arranged to engage the tool housing to positively locate said transfer means in said loading position;

(b) means adjacent to said transfer means providing a surface for blocking a forward end of said passage against expulsion of a retained power charge when said transfer means is between said rest and loading positions;

(c) support means adapted to support a container holding a supply of power charges, the container being retained completely externally of said housing; and means forming a feed opening which is aligned with said through passage from the container whereby power charges can pass into said through passage when said transfer means is in said charge-receiving position; and (d) a surface on said transfer means being disposed adjacent to said feed opening to prevent passage of a charge therethrough whenever said transfer means is out of said rest position.

7. The loading assembly of claim 6, wherein said container is supported rearwardly of said loading port, and said feed opening opens forwardly of said container and is sized to pass a charge by gravity therethrough when the tool is in a muzzle-down position.

8. The loading assembly of claim 6, further comprising spring means engaging said transfer means to bias the latter toward said charge-receiving position.

9. The loading assembly of claim 6, wherein the axes of said feed opening and said through passage are maintained parallel to the barrel assembly axis, and the direction of pivotal movement of said transfer means is in planes normal to the axis of the barrel assembly.

* * * * *

UNITED STATES PATENT OFFICE

CERTIFICATE OF CORRECTION

Patent No. 4,112,685 Dated September 12, 1978

Inventor(s) Marc Combette and Jean Ollivier

It is certified that error appears in the above-identified patent and that said Letters Patent are hereby corrected as shown below:

Col. 3, line 51; delete "still"

Col. 6, line 37; change "part" to --port--.

Signed and Sealed this

*Fourteenth* Day of *October 1980*

[SEAL]

*Attest:*

SIDNEY A. DIAMOND

*Attesting Officer* *Commissioner of Patents and Trademarks*